United States Patent [19]

Furst

[11] Patent Number: 4,833,991

[45] Date of Patent: May 30, 1989

[54] SUBMUNITION INCORPORATING A FUZE

[75] Inventor: Wilhelm Furst, Buchberg, Fed. Rep. of Germany

[73] Assignee: Diehl GmbH & Co., Nuremberg, Fed. Rep. of Germany

[21] Appl. No.: 151,716

[22] Filed: Feb. 3, 1988

[30] Foreign Application Priority Data

Mar. 3, 1987 [DE] Fed. Rep. of Germany ..... 3706819

[51] Int. Cl.[4] ..... F42C 15/40

[52] U.S. Cl. ..... 102/215; 102/206; 102/393; 102/489

[58] Field of Search ..... 102/206, 215, 218–221, 102/262, 264, 393, 401, 427, 489

[56] References Cited

U.S. PATENT DOCUMENTS

| | | | |
|---|---|---|---|
| 4,089,268 | 5/1978 | Jaroska et al. | 102/221 |
| 4,368,670 | 1/1983 | Weidner | 102/202.5 |
| 4,374,492 | 2/1983 | Goldberg et al. . | |
| 4,421,030 | 12/1983 | Dekoker | 102/218 |
| 4,522,356 | 6/1985 | Lair et al. | 102/489 |
| 4,587,902 | 5/1986 | Lindner et al. | 102/213 |
| 4,602,565 | 7/1986 | MacDonald et al. | 102/202.7 |

FOREIGN PATENT DOCUMENTS

| | | | |
|---|---|---|---|
| 3317376 | 11/1984 | Fed. Rep. of Germany | 102/215 |
| 3329700 | 3/1985 | Fed. Rep. of Germany . | |
| 3706819 | 9/1988 | Fed. Rep. of Germany . | |

*Primary Examiner*—Charles T. Jordan

*Attorney, Agent, or Firm*—Scully, Scott, Murphy & Presser

[57] ABSTRACT

An article of submunition including a fuze or detonating device which can be armed in dependence upon environmental conditions, and wherein the fuze is electrically actuatable from an accumulator or energy storage. The submunition is provided with an in-line detonating medium for the attacking or combat charge of the submunition, whose detonating-energy storage can be connected to an energy source through the interposition of an interrupter across a securing device (safety) which is arranged in a carrier for the submunition. Only a single central securing or safe device is required for all articles of submunitions which are deployable by means of one carrier; in effect, for all fuzes or trigger devices, and this single, central securing device can be arranged within the carrier itself.

4 Claims, 2 Drawing Sheets

SUBMUNITION INCORPORATING A FUZE

BACKGROUND OF THE INVENTION

1. Field of the Invention

The present invention relates to an article of submunition including a fuze or detonating device which can be armed in dependence upon environmental conditions, and wherein the fuze is electrically actuatable from an accumulator or energy storage.

2. Discussion of the Prior Art

Submunition of that type, in a functional interrelationship with its fuze, is usually equipped with a complete securing device; in effect, self-sufficiently operating within the respective submunition, which causes an arming of the submunition only first in dependence upon the presence of certain surroundings or environmental criteria (such as the reaching of a lurking position or free flight after leaving a carrier).

SUMMARY OF THE INVENTION

The present inventin has an object the reduction on demand for apparatus for the reliable armed positioning of submunition, and as a result thereof, in the same measure, to open up a greater degree of operational reliability, as well as more inexpensive capabilities for operational testing and for the exchange of components which are operationally essential.

The foregoing object is inventively achieved in that the submunition of the type under consideration herein is provided with an in-line detonating medium for the attacking or combat charge of the submunition, whose detonating-energy storage can be connected to an energy source though the interposition of an interrupter across a securing device (safety) which is arranged in a carrier for the submunition.

The foregoing is based on the consideration that it is possible to combine the securing function for all articles of submunition, which are deployed by means of a carrier, into a single securing device which is itself located within the carrier, when there is eliminated an armed position in the fuze of the respective submunition by way of the mechanical in-line displacement of a detonator. In turn, this is again rendered possible when the function of the detonating medium (for the triggering of the attacking or combat charge) is based on the utilization of insensitive explosive mixtures, a so-called secondary explosive, which is detonatable through electrically-generated mechanical energies; for instance, as described in the disclosures of U.S. Pat. Nos. 4,368,670 or 4,602,565. This is because the military safety criteria or standards for fuzes (US-MIL-STD-1361C of Feb. 15, 1977, paragraph 4.3.3a; or respectively, NATO-Stanag 3525 AA of Jan. 25, 1976, paragraph 5) allow for the implementation of a securing or safe device without any mechanical explosive-train interruption during the employment of the above-mentioned, insensitive secondary explosive.

Pursuant to the inventive concept, there is consequently required only a single central securing or safe device for all articles of submunitions which are deployable by means of one carrier; in effect, for all fuzes or trigger devices, and this single, central securing device can be arranged within the carrier itself; in essence, it is easily accessible independently upon the equipping of the carrier with submunition for purposes of testing and exchanges whereas the submunition itself is relieved from this constructive and functional safety requirement; essentially, needs to be equipped with only the still absolutely necessary parts for the functioning of the fuze. This simplification in the equipping of the submunition with the central securing device for the supplying of all articles of submunitions leads to a substantial simplification; in effect, a more inexpensive implementability at an increased operational reliability for the submunition.

Hereby, it must be considered that the expensive and voluminous energy source, as well as the operationally-critical safety switch for each submunition carrier need be provided only a single time; namely, within the carrier, and wherein the environmental arming criteria can basically be easier functionally introduced into the carrier than into submunitions which are located in the carrier.

Moreover, there is no necessity of providing a complicated boundary or joint location between the carrier and the articles of submunition, inasmuch as a simple tearing bridge or interrupter would be adequate along the path of the charging line between the energy source of the carrier and the energy storage for the submunition.

For each article of submunition there is also obtained complete safety in the individual handling thereof, irrespective as to whether the individual submunition is or is not equipped with the complete securing or safety device. This is because since only through the tearing bridge or interrupter can the necessary energy be delivered by the extremely high charging voltage which is obtainable from the generator in the carrier, by means of which the energy storage in the submunition is charged up to the required value, and through which there can be activated the detonating medium for the secondary explosive. However, the disruptive environment or surroundings which is encountered during the isolated manipulation of the individual articles of submunition, does not deliver the necessary electrical voltage (in the magnitude of a few thousands of volts) for the triggering of the denotaing means.

When the point in time for the ejection of the submunition from the carrier is located beyond a preliminary or perimeter safety time interval, than the preliminary safety criteria can also in itself be positioned in the securing device within the carrier; in effect, there can to that extent, take place an unburdening of the submunition.

The inventively equipped submunition is insensitive to mechanical disruptive influences caused by the surroundings, inasmuch as it no longer contains any movable component, and especially no mechanically displaceable securing component. Its structure is no longer weakened, inasmuch as the arming environmental criteria are to be introduced only into the carrier itself, but not into its submunition; thus, for example, there are no longer required any sensor pins or windmill-generator carriages on the submunition which must be displaced outwardly from the casing of the submunition.

BRIEF DESCRIPTION OF THE DRAWINGS

Additional alternatives and modifications, as well as further features and advantages of the invention can now be readily ascertained from the following detailed description of an exemplary embodiment of the invention, taken in conjunction with the accompanying drawings; in which.

DETAILED DESCRIPTION

Each article of submunition 11 can relate, in the same measure, to ejectable ammunition possessing impact detonators (for example, such as disclosed in German Laid-Open Patent Appln. No. 33 17 376), to controllably-launched ammunition with proximity fuzes or impact detonators (for example, as disclosed in German Laid-Open Patent Appln. No. 33 29 700), to ammunition incorporating search-head fuzed (for example, as described in U.S. Pat. No. 4,587,902) or to guided ammunition (for example, as illustrated by the system MLRS III or described in U.S. Pat. No. 4,522,356). The deployment of such submunition 11 into the starting or launching (ejection or firing or launching position) position carried out, for instance, such as through the intermediary of unmanned airborne bodies (drones, remote distance weapon dispensers, projectiles, missiles or rockets), or by means of launching devices which are deployed in a lurking position, whereby it is, in principle, of no consequence as to whether the carrier 12 is equipped with only one or more articles of submunition 11 which are to be activated simultaneously or staggered; however, basically, it can also be provided a manned carrier 12 (for example, an aircraft or submarine), when through the employment of suitable preliminary safety measures in the discharged submunition 11 there is prrecluded any endangerment of the carrier.

Figure 1:
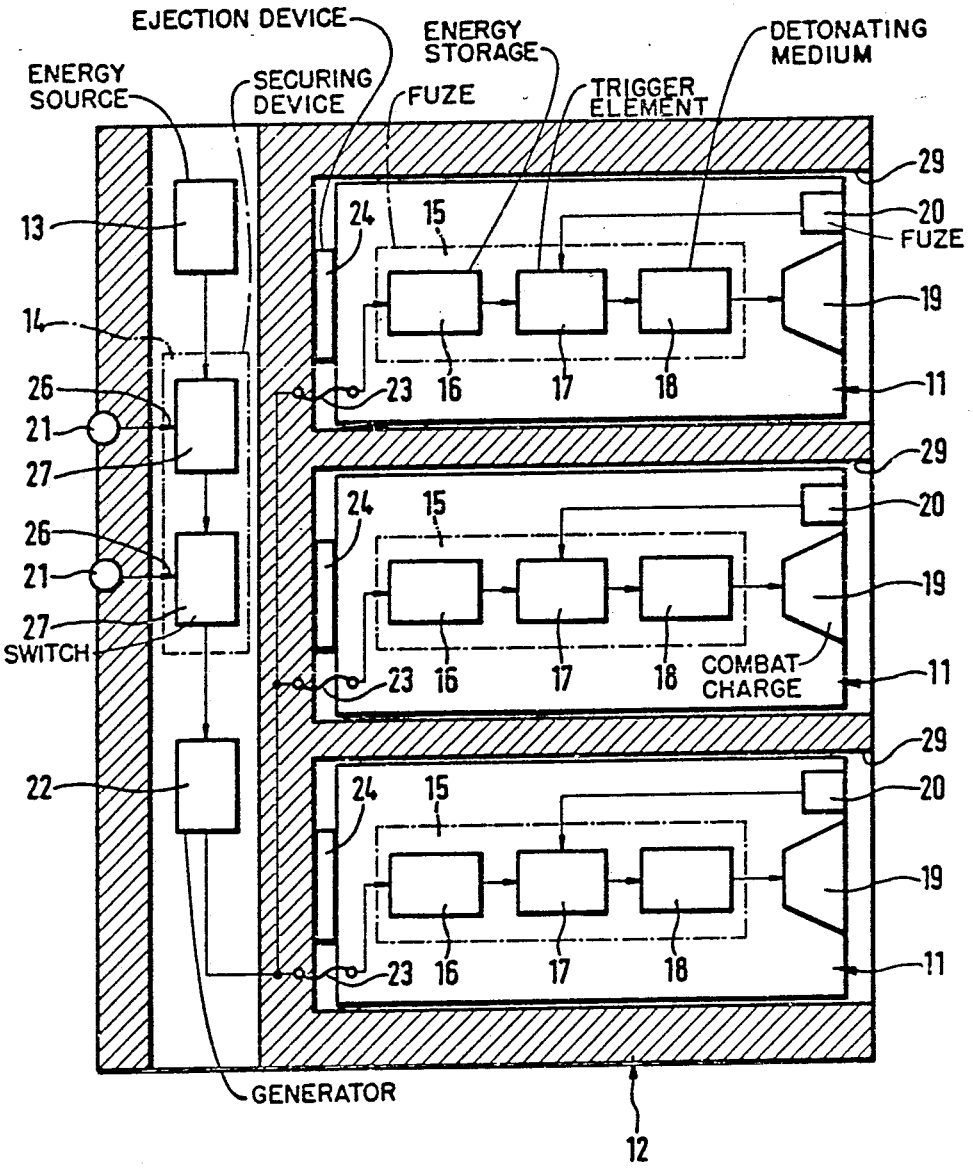
FIG. 1 illustrates the basic subdivision between, on the one hand, the energy source and the safety switches, as well as, on the other hand, the fuzes which are arranged intermediate a submunition carrier and a plurality of articles of submunitions contained therein.

In the drawing of FIG. 1 there is illustrated that for a large number of articles of submunition 11 there is provided only a single energy source 13 (for example, in the form of a battery which is thermally activated or through environmental influences, such as sea water), namely outside of the submunition 11 on the carrier 12. Moreover, the securing device 14 is only provided one time, in common for all submunitions 11 which are deployable by means of the carrier 12. Each article of submunition 11 which is maintained in the carrier 12 in preparedness for firing or ejection, is merely provided with a fuze 15, containing an electrical charging storage 16 (the so-called triggering capacitor) and a mechanical or electrical trigger element 17 (for example, an electronically-actuatable switch, such as a thyristor) in series with a detonating medium 18 for a secondary explosive. This triggers the attacking or combat charge 19, when the fuze 20 responds, after leaving the submunition carrier 12, in effect, activates the trigger element 17; to the extent that the energy storage 16 has been charged prior to a separation of the submunition 11 from the carrier 12, since environmental sensors 21 have delivered their arming criteria to the securing device 14, which is electrically connected between the energy source 13 and the energy storages 16.

After response of the sensors 21 there is then charged the energy storage 16, possibly through a generator 22 for current and voltage correlation, across an interrupter or tearing bridge 23 which is located between the carrier 12 and the respective submunition 11, which bridge is separated when the respective ejection device 24 for the ejection or the launching of the submunition 11 from its carrier 12 is triggered from a control installation (not shown).

Figure 2:
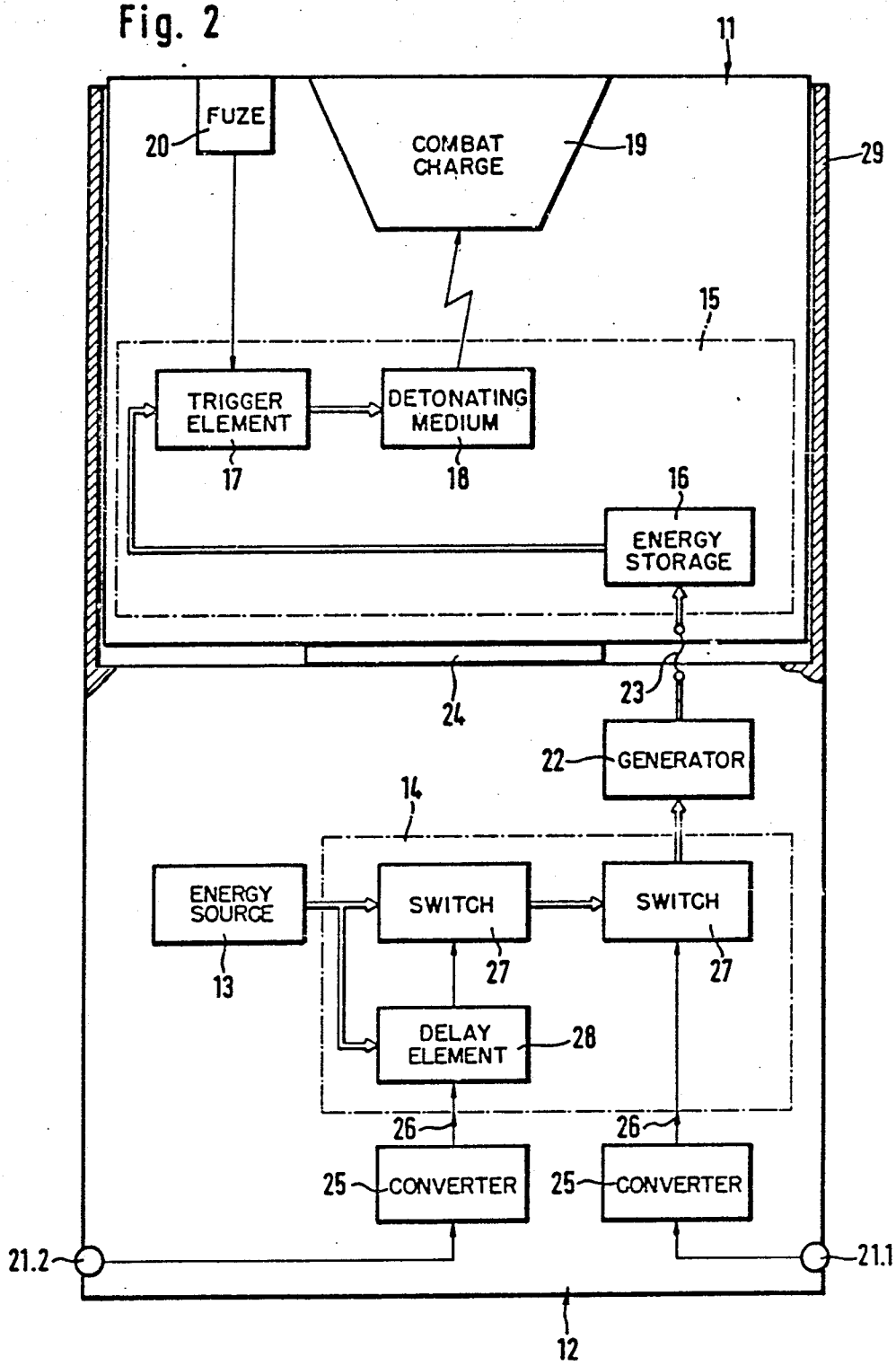
FIG. 2 illustrates a schematic block circuit diagram of the operational subdivision between the submunition and the carrier pursuant to FIG. 1 shown in a detailed representation, particularly with respect to the arming criteria.

The specific embodiment which is illustrated by way of example in FIG. 2 of the drawings, preferably pertains to a particular instance of utilization pursuant to the above-mentioned German Laid-Open German Patent Appln. No. 33 29 700, wherein only a single article of submunition 11 is provided fo each carrier 12. Provided an environmental arming sensors 21 are a scanner 21.1 (for detection of the egress from the tube of a launcher, by means of which the carrier 12 is deployed in conjunction with submunition 11) and a pressure membrane 21.2 (which only responds after descent to a sufficient water depth); instead thereof or in addition thereto there can also be provided sensors 21 acting otherwise, such as a set-down sensor (not shown), which responds to the reaching of a lurking position at the water bottom or seabed. The informations which are delivered by the sensors 21 can be transmitted mechanically (for example, through a displacement of linkages) or electrically (for example, as a voltage level), which are processed in either mechanical, electromechanical or electrical converters 25 for the arming informations 26 which are adapted for influencing the securing device 14.

In the securing device 14, each sensor 21 has, as a rule, a (electrical or mechanical) switch 27 associated therewith, which functionally produce an AND juncture; for example, which as illustrated are connected in series. At least one of the switches 27 is not directly actuated by the arming information 26, but through a delay element 28 for preliminary safety purposes. This elemet can be operated from the central electrical energy source 13; or may be equipped with its own energy source (not shown); for example, with an automatic or spring-loaded energy device in the case of its construction as a mechanical clockwork.

When, in addition to the switch 27 which is directly provided with an arming inforation 26, there is also actuated the further switch 27 after completion of the preliminary securing delay-time interval, the power circuit from the energy source 13 is closed across the generator 22 and the interrupter or tearing bridge 23, and the energy storage 16 in the fuze 15 is charged. The ejecting arrangement 24 can now be initiated and with the rising away of the submunition 11 from the retaining conduit 29 of the carrier 12, the bridge 23 is ripped open, inasmuch as the electrical detonating energy now stands available in the launched submunition; in effect, the submunition 11 is armed. Upon response of the fuze 20 for the warhead (for example, due to approach to the target or impact against the target) and the resultingly actuated trigger element 17, the energy is discharged from the energy storage 16 into the detonating means 18 for the secondary explosive, as a result of which, without the necessity for a detonator which must be previously mechanically pivoted into line, there is directly triggered the attacking or combat charge 19.

In FIG. 2 of the drawing, for purposes of simplifying the representation, the mode of operation of the fuze 20 has not been elucidated. In the event that electrical energy is required for its function, it can be contemplated (not shown in the drawing) to additionally connect the fuze to the energy storage 16, or to equip it with its own energy storage, which is supplied from the generator 22 either through the interrupter or bridge 23 in parallel with the fuze energy storage 16, or across a second interrupter or bridge directly from the energy source 13. With respect to the bridges 23, these can relate to ohmic connections (plug contact, ripping wire) or to other coupling elements (for example,optronic or inductive couplings).

What is claimed is:

1. Submunition including an environmentally-dependent armable fuze; an energy storage for electrically actuating said fuze; an in-line detonating means for the combat charge of the submunition being arranged in the submunition, said energy storage being connectable across a tear bridge to an energy source through a securing device which is located in a carrier for the submunition.

2. A submunition as claimed in claim 1, wherein said securing device includes at least two switches connected through AND junctures; and environment sensors for supplying said switches with arming informations.

3. A submunition as claimed in claim 2, wherein at least one of the switches is actuatable across a delay element by the arming information.

4. A submunition as claimed in claim 1, wherein a generator is arranged in said carrier for the charging of the energy storage for the fuze on board the submunition.

* * * * *